United States Patent [19]

Jackson

[11] Patent Number: 4,650,701

[45] Date of Patent: Mar. 17, 1987

[54] ORNAMENTAL DEVICE AND METHOD OF CONSTRUCTING SAME

[76] Inventor: James G. Jackson, 7-C W. 57th St., Savannah, Ga. 31401

[21] Appl. No.: 810,663

[22] Filed: Dec. 19, 1985

[51] Int. Cl.[4] ..... A63H 3/04

[52] U.S. Cl. ..... 428/16; 156/61; 428/256; 446/370; 446/374

[58] Field of Search ..... 428/4, 16, 256; 446/370, 374; 156/61

[56] References Cited

U.S. PATENT DOCUMENTS

| | | | |
|---|---|---|---|
| 305,102 | 9/1884 | Nelson | 428/16 X |
| 1,606,354 | 11/1926 | Fillion | 428/16 X |
| 2,496,951 | 2/1950 | Menzin | 446/370 |
| 2,793,454 | 5/1957 | Shoemaker | 428/16 |
| 2,803,903 | 8/1957 | Barry | 156/61 X |
| 2,812,616 | 11/1957 | Ford | 446/374 |
| 3,163,418 | 12/1964 | Myers | 428/16 X |
| 3,695,982 | 10/1972 | Brody | 428/16 |
| 4,112,573 | 9/1978 | Moye | 428/16 X |
| 4,123,872 | 11/1978 | Silva | 428/4 X |
| 4,235,767 | 11/1980 | Blount | 524/800 X |
| 4,258,503 | 3/1981 | Bales | 428/16 X |

*Primary Examiner*—Henry F. Epstein

*Attorney, Agent, or Firm*—Newton, Hopkins & Ormsby

[57] ABSTRACT

An ornamental device is disclosed having main frame members of braided wire, support members, and spanning members for forming the outline of the device. The device is normally formed in two halves which are mated before a screen is laid over the superstructure and fastened thereto. Various detailing methods are then used to accentuate distinctive features using commonly found materials such as metal, glass and paper.

17 Claims, 3 Drawing Figures

ORNAMENTAL DEVICE AND METHOD OF CONSTRUCTING SAME

BACKGROUND OF THE INVENTION

A common sight during the various holiday seasons is the presence of ornamental devices, particularly in public places such as parks or shopping malls, or on individual lawns or yards. The ornamental devices or decorations are found in many forms, for example; creche displays or a Santa Claus with reindeer during the Christmas season, displays of ghosts or other such figures during the Halloween season, or various patriotic displays honoring certain historical events. In addition, many of such displays or devices are found on floats used for holiday parades.

Such devices or displays serve to accentuate the particular season, entertain those who view the displays, and add an ornamental touch to their particular location. In the past, many of such devices were created in or from plastic forms and then painted, or with larger displays, such as floats, constructed with a wooden superstructure covered with chicken wire. The wire might then be covered with papier-mâché or with tissue flowers to illustrate the particular character or structure.

While generally effective, such construction methods and features are normally quite expensive and time-consuming. In addition, the essential materials used may be difficult to obtain and to alter once constructed, if modifications are desired.

SUMMARY OF THE INVENTION

It is, therefore, one of the principal objects of the present invention to provide an ornamental device that is easily constructed using common, inexpensive materials, and which may be built in a plurality of shapes and sizes.

Another object of the present invention is to provide an ornamental device that can be constructed easily without the need for special machinery or specialized skills, and which also does not require special tools.

A further object of the present invention is to make the use of such ornamental devices a more widely practiced art by providing a simplified method of constructing the device.

These and additional objects are attained by the present invention which relates to an ornamental device having a flexible superstructure of wire or other suitable material such as thin, flat, metallic stock which can be molded to the desired shape. The material is such that the device will retain the given shape. A suitable fabric means such as screen wire is secured over the superstructure, suitable fastening means such as fine wire being used to hold the screen wire in place. The detailed features of the ornamental device are normally of a reflective nature, such as glass or the like, which provides accentuation of the detailed features.

The present invention also includes a simplified method of construction which may be used to produce a variety of ornamental devices, the details of which are explained herein. The present device is also characterized by economy of manufacture, many of the materials used being commonly available for little or no expense.

Various other objects and advantages of the present invention will become apparent from the description below, with reference to the accompanying drawings.

DETAILED DESCRIPTION OF THE PREFERRED EMBODIMENT

Figure 1:
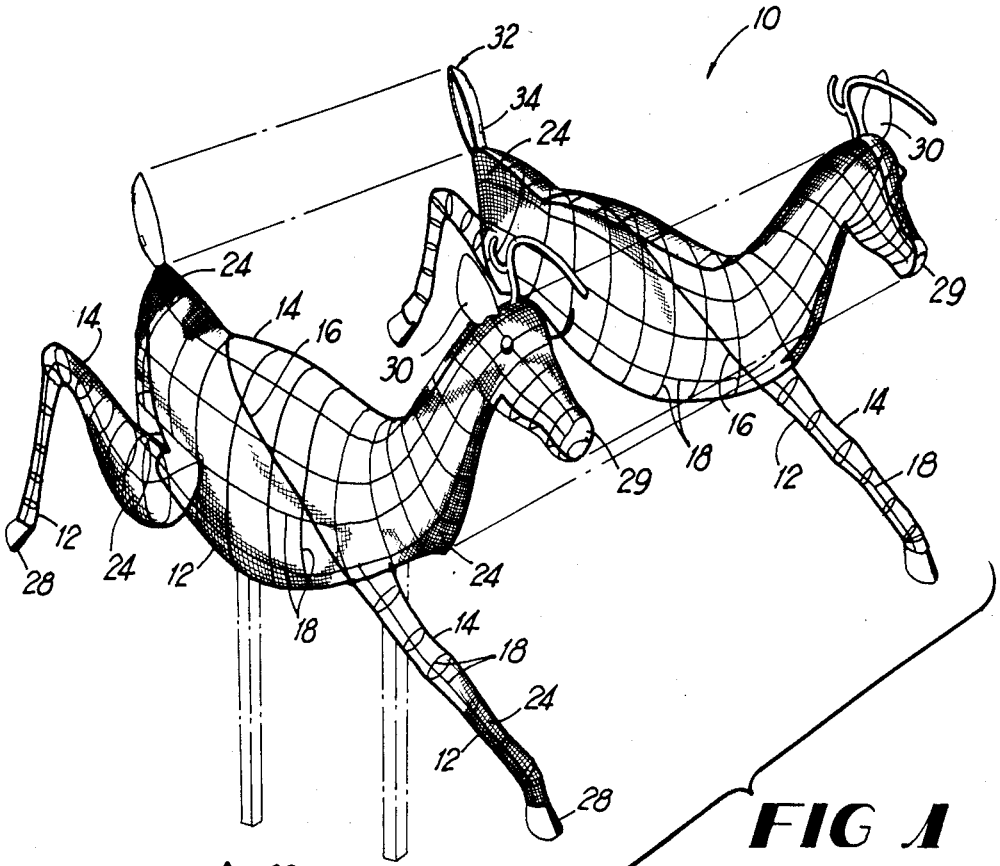
FIG. 1 is an exploded perspective view of one embodiment of an ornamental device according to the present invention, partially illustrating the method of construction.

Referring now more specifically to the drawings, and to FIG. 1 in particular, numeral 10 designates generally one embodiment of an ornamental device according to the present invention. The drawings illustrate one form which the present device may take, that of a reindeer; however, this is not meant to limit the invention in any way. Various other ornamental devices may be constructed according to the method detailed herein, the reindeer serving only as a representative embodiment.

The superstructure of the present invention is normally constructed in right and left halves, as shown in FIG. 1 to form a three-dimensional figure. The present invention also contemplates; however, a figure formed in a right or left half only. Such a two-dimensional figure could then be mounted adjacent a wall or other structure. The main frame member of each half is normally a wire means, such as wire 12. It is generally preferable to have a continuous length of wire running from the front end of the device to the back, although individual lengths of wire may be connected together to produce the same effect. As shown here, a bottom wire 12 runs from the front leg to the back leg along the bottom or belly portion of the reindeer. A top wire 14 also runs from the front leg to the back leg, but along the upper portion of the structure.

Figure 2:
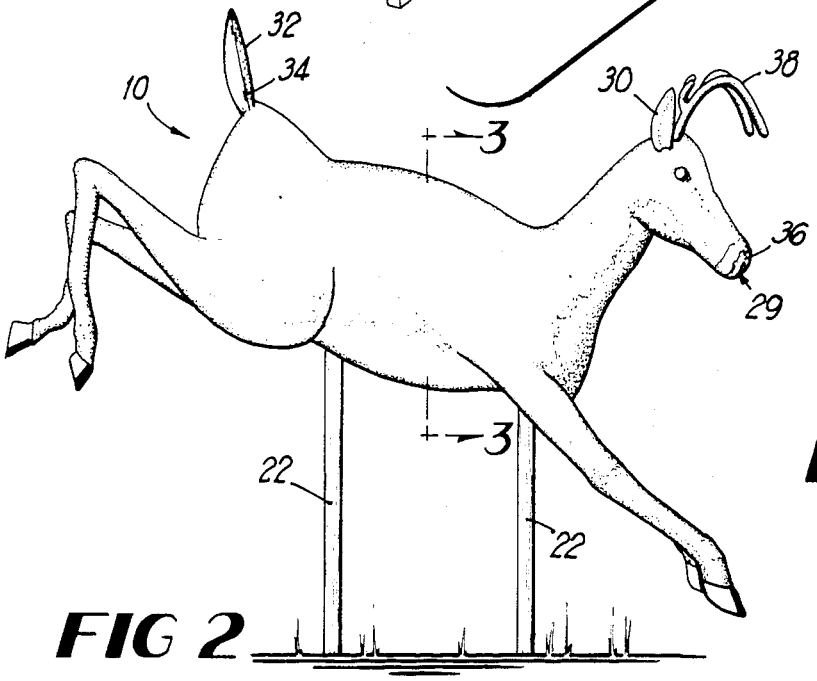
FIG. 2 is a side elevational view of the ornamental device shown in the preceding figure, showing the device in assembled form.

This wire is normally of a relatively heavy gauge or separate strands of a lighter gauge wire may be twisted or braided together to hold the desired shape. One example of a suitable wire gauge is the type used for common clothes hangers, the wire being braided generally along the entire length of each side. This is advantageous since, as shown in FIG. 2, the superstructure of each side may be given a slightly different configuration to enhance the appearance of the completed device.

Additional heavy gauge or braided wire is used for support members 16 which extend from the bottom wire 12 to the top wire 14, providing stability for the upper and lower perimeters of the device. The number and relative location of the support members required will vary with the particular structure being built, member 16 being shown here as an example of a suitable arrangement. The separate halves are then provided with further spanning structural members or wires 18 as needed, the spanning members normally, but not necessarily, being of a lighter gauge wire than the frame members.

With the superstructure completed, the separate halves are mated and secured together with a suitable fastening means, such as short wire pieces 20 which are twisted or otherwise secured around the upper perimeter and the limbs or other extensions of the particular device, the bottom or lower central portion normally being left open to receive suitable supporting means, such as struts or stanchions 22. This will, of course, vary with the particular figure being constructed, some having self-supporting capability but, in general, the portion facing the base or ground may be left open.

Figure 3:
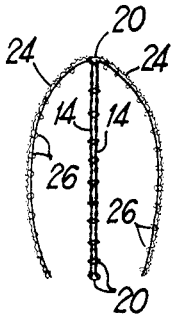
FIG. 3 is a schematicized cross-sectional view of the present device taken substantiallly on line 3—3 in FIG. 2.

The outer skin of the present invention is a suitable fabric material, such as screen wire 24 or mesh-type material, which may be metallic or a synthetic fiber material. The material is fastened to the superstructure with a suitable securing means, such as a fine or narrow gauge wire 26 that is stitched through the screen 24 and around the framework, as shown in FIG. 3. The screen may be painted as desired, depending on its original color and on the figure being depicted.

Certain detail parts, such as the hooves 28, mouth 29, ears 30 and tail 32, in the figure shown, are formed from a malleable material such as galvanized sheet metal which can be cut and shaped to the desired configuration. As shown in FIG. 1, the material is cut to shape and provided with tab members 34 which can be bent over the corresponding opposite half or around a frame wire, as the particular figure permits.

Further detailing of certain parts, such as the nose of the reindeer shown, are accented with a reflective material, such as crushed glass or ceramic material. The nose, for example, has crushed red glass 36, mixed in clear epoxy and applied to the galvanized metal. This accentuates the well-known "red-nose reindeer" and the epoxy seals over any sharp glass edges. Similarly, where white detailing was desired in the figure shown, as on the ears, crushed porcelain or ceramic material is used with the epoxy base.

The antlers 38 of the reindeer shown here are formed from a suitable material which can be shaped into various forms, papier mâché being used in this embodiment. The antlers may also have an inside wire framework if desired, and the papier mâché may have crushed porcelain mixed therewith also. Other suitable and similar materials may also be used, with particular advantages being derived from the use of materials commonly found around a house or even materials destined to be thrown away, the latter providing a particular economic benefit.

The method of constructing the ornamental device is substantially as described above, the superstructure being formed in two halves which are then mated. The main frame members 12 and 14, preferably a heavy gauge or braided wire and of continuous length, is molded to the desired configuration at the perimeter of the figure. Support members 16 are then added to connect the upper and lower perimeter members and to add bracing stability to the figure. Spanning members 18 are then used to complete the superstructure, providing the outline of the figure.

The separate halves are mated and secured with suitable wire means 20, the bottom or base-facing portion of the figure normally being left open to receive supports 22. Screen wire 24 is then stitched to the superstructure and may be painted as desired.

Detail features, here the nose, ears, hooves and tail, are formed from malleable material, cut to shape and provided with tabs 34 for securing these members to the frame. Accentuation of certain features is provided by crushed, colored glass, or porcelain or ceramic material, which is mixed with clear epoxy to bind the glass to the figure and to seal over any sharp edges. Various other common materials may also be used in various parts of the figures, here, papier mâché being used for the antlers. The present device may then be supported or mounted in a suitable manner, such as with supports 22, shown here.

While an embodiment of an ornamental device has been shown and described in detail herein, various changes and modifications may be made without departing from the scope of the present invention.

I claim:

1. An ornamental device comprising a superstructure having right and left halves, each half having a main upper and lower frame member and each with a distinct configuration for substantially defining the perimeter of said device, a support member extending from and connecting said upper frame member to said lower frame member, spanning members extending from and connecting said upper and lower frame members with said support member and with other spanning members, fabric means overlying said superstructure and being secured thereto, and securing means for fastening said fabric means to said superstructure.

2. An ornamental device as defined in claim 1 in which said upper and lower main frame members have a plurality of wires braided together and extending substantially continuously from the front to the rear of said device.

3. An ornamental device as defined in claim 2 in which said spanning members include generally longitudinal and latitudinal members, disposed approximately perpendicularly with respect to one another.

4. An ornamental device as defined in claim 3 in which said fabric material includes a wire mesh screen and said securing means includes fine gauge wire for stitching said screen to said superstructure.

5. An ornamental device as defined in claim 1 in which said fabric material includes a wire mesh screen and said securing means includes fine gauge wire for stitching said screen to said superstructure.

6. An ornamental device as define in claim 1 in which said right and left halves are individually constructed and secured together at the perimeters thereof.

7. An ornamental device comprising a superstructure constructed in generally identical halves, comprising upper and lower main frame members defining the perimeter of each half, support means connecting said upper and lower members, spanning members connecting said support means with said upper and lower members and with one another, fastening means for securing said halves together, fabric means overlying said halves, and securing means for holding said fabric means to said halves.

8. An ornamental device as defined in claim 7 in which said upper and lower main frame members extend generally continuously from one end of the device to the other.

9. An ornamental device as defined in claim 8 in which said fabric material includes a wire mesh screen and said securing means includes fine gauge wire for stitching said screen to said superstructure.

10. An ornamental device as defined in claim 7 in which said fabric material includes a wire mesh screen and said securing means includes fine gauge wire for stitching said screen to said superstructure.

11. A method of constructing the superstructure of an ornamental device comprising the steps of:

a. molding first upper and lower main frame members to form the approximate perimeter of one half of said device;

b. molding second upper and lower main frame members to form the approximate perimeter of a second half of said device;

c. connecting a support member between upper and lower portions of each of said frame members;

d. connecting spanning members with said frame members and support members and with one another to form the approximate outline of said device;

e. securing the separate havles together;

f. laying fabric means over said connected halves;

g. fastening said fabric means to said connected halves;

h. molding a malleable material around portions of said device for detailing features; and i. mixing crushed glass in clear epoxy and applying said glass and epoxy to portions of said malleable materials.

12. A method as defined in claim 11 including the further step of braiding at least two wire strands to form said frame members.

13. A method as defined in claim 12, including the further step of painting said fabric means.

14. An ornamental device comprising a superstructure having right and left halves, each half having a main upper and lower frame member and each with a distinct configuration for substantially defining the perimeter of said device, a support member extending from and connecting said upper frame member to said lower frame member, spanning members extending from and connecting said upper and lower frame members with said support member and with other spanning members, fabric means overlying said superstructure with securing means for fastening said fabric means to said superstructure, and malleable metal for forming detail features of said device, having tab members for securing said metal to said superstructure, with crushed glass applied thereto and sealed in epoxy for providing color to said detail features.

15. An ornamental device as defined in claim 14 in which said fabric material includes a wire mesh screen and said securing means includes fine gauge wire for stitching said screen to said superstructure, said fabric material also having paint applied thereto.

16. An ornamental device as defined in claim 14 in which said device includes crushed porcelain applied to said metal and said fabric means and sealed in epoxy for providing further detail features.

17. An ornamental device as defined in claim 14 in which said device includes upper and lower main frame members having a plurality of wires braided together and extending substantially continuously from the front to the rear of said device.

* * * * *